US006347963B1

(12) United States Patent
Falkenberg et al.

(10) Patent No.: US 6,347,963 B1
(45) Date of Patent: Feb. 19, 2002

(54) INTERCHANGEABLE BACKPLANE INTERFACE CONNECTION PANEL

(75) Inventors: Dean R. Falkenberg, Windsor; Edward T. Iwamiya, Petaluma; Paul M. Elliot, Jenner; Dyke T. Shaffer, Santa Rosa, all of CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 09/470,261

(22) Filed: Dec. 22, 1999

(51) Int. Cl.[7] ..... H01R 25/00
(52) U.S. Cl. ..... 439/638; 439/61; 361/788
(58) Field of Search ..... 439/61, 638, 488, 439/491, 521, 528; 361/788

(56) References Cited

U.S. PATENT DOCUMENTS

| | | | | |
|---|---|---|---|---|
| 4,498,119 A | * | 2/1985 | Cronin | 439/61 |
| 4,686,608 A | | 8/1987 | Hosking | 361/428 I |
| 4,708,430 A | | 11/1987 | Donaldson et al. | 350/96.2 |
| 4,846,705 A | | 7/1989 | Brunnenmeyer | 439/78 |
| 4,911,662 A | | 3/1990 | Debortoli et al. | 439/719 |
| 5,044,966 A | | 9/1991 | Friesen | 439/78 |
| 5,430,615 A | * | 7/1995 | Keeth et al. | 361/788 |
| 5,460,547 A | * | 10/1995 | Belt et al. | 439/638 |
| 5,533,917 A | * | 7/1996 | Schmitz | 439/491 |
| 5,546,282 A | | 8/1996 | Hill et al. | 361/796 |
| 5,778,130 A | | 7/1998 | Walters et al. | 385/134 |
| 6,154,373 A | * | 11/2000 | Durston et al. | 439/61 |

FOREIGN PATENT DOCUMENTS

| | | | | |
|---|---|---|---|---|
| JP | 401140797 | * | 6/1989 | 361/788 |

* cited by examiner

*Primary Examiner*—Tho D. Ta
(74) *Attorney, Agent, or Firm*—Skjerven Morrill MacPherson LLP

(57) ABSTRACT

A system and method for converting the numerous quantities, types, and arrangements of plug-in card connectors, usually disposed on the backplane of equipment systems, to an orderly and standardized array of external connectors. The external connectors facilitate the electrical connection between the cards and one of a variety of specific external cable connectors.

19 Claims, 12 Drawing Sheets

INTERCHANGEABLE BACKPLANE INTERFACE CONNECTION PANEL

BACKGROUND OF THE INVENTION

Most modem equipment for implementing telecommunications systems contain one or more electronic apparatus housed in a casing. The casing is generally enclosed, with a front access door, sidewalls, and a backplane forming the casing. Generally, the electronic apparatus is located within the casing and is electrically coupled to the backplane. In most instances, the backplane performs an interconnect function between the various electronic apparatuses within the casing. The backplane also typically supports connectors, which allows an electrical connection to be made between the electronic apparatuses coupled to the backplane and external cables, wires and leads located outside the casing.

Such connectors are typically included in the above-described electronic apparatuses which may be in the form of, e.g., plug-in cards. Different manufacturers and/or distributors of plug-in cards often do not employ uniformity in the types of connectors supported on the cards. Thus, when cards are replaced in telecommunication systems, either due to failure or because of an upgrade, it is not uncommon to find that the connectors on the new cards are no longer compatible with connectors on external cables previously used with the replaced cards.

Moreover, when a plug-in card is added to the backplane, a person adding the card (also called installer) must find space for the connectors on the added card, such that one or more connectors do not interfere with the functioning of the backplane. Since most backplanes are not designed to accommodate multiple connectors, installers usually locate the connectors on fringe areas of the backplane or else on a new backplane, subsequently added to the system.

SUMMARY OF THE INVENTION

In accordance with the present invention, a system and method convert the numerous quantities, types, and arrangements of plug-in card connectors usually disposed on the backplane of telecommunication systems to an orderly and standardized array of external connectors. The external connectors facilitate electrical connection between cards in a casing and one of a number of predetermined cable connectors of cables external to the casing.

As described in greater detail below, one or more electronic apparatuses, such as modules, PCAs, PCBs, video cards, audio cards, ethernet cards, or other types of plug-in cards, may be electrically coupled to a first side (also called "internal face") of the backplane. On the opposite or second side (also called "external face") of the backplane, a standardized arrangement of connectors, (e.g., pin-type connectors) are provided. The internal face of the backplane has connectors (also called "card connectors") that receive the variety of plug-in cards. The backplane routes a signal path from the card connectors to the standardized arrangement of connectors (also called "cable connectors") on the external face.

One embodiment of the system provides a conversion panel. The conversion panel has a first side (also called "internal face") having a standardized connector arrangement configured to mate with the cable connectors on the external face of the backplane. On the second side (also called "external face") of the panel, another set of external connectors (also called "cable connectors") is provided. The external connectors on the conversional panel are different from the cable connectors on the backplane, e.g., one of a variety of connectors suitable for a specific application, such as SMB, BNC, RJ-45, SMB-WW and BNC-WW module, screw terminal block, coaxial F, and champ connectors. The system includes the ability to remove and replace the conversion panel, as needed or desired, such that the type, quantity and/or arrangement of cable connectors on an external face of the casing may be changed.

In one embodiment of the present invention, a system is provided which provides a standardized electrical connection to a backplane of a card-based equipment system. The system includes a main chassis which defines an interior space for receiving plug-in cards. Also included is a backplane, which has a first side and a second side. The first side of the backplane has a plurality of plug-in card sockets for engaging with the plug-in cards. The second side of the backplane has an arrangement of backplane connectors. An interchangeable connection panel is also provided, which has a front side and a back side. The front side of the panel has panel connector receptacles configured to mate with the backplane connectors. The back side of the panel has a plurality of external connectors for establishing an electrical connection to an external cable.

In yet another embodiment of the present invention, a method is provided for standardizing an electrical connection interface of a card based equipment system, which includes coupling a conversion panel to a backplane connector array having different types of connectors, where the conversion panel has a plurality of external connectors for establishing an electrical connection to an external cable.

DETAILED DESCRIPTION

Figure 1:
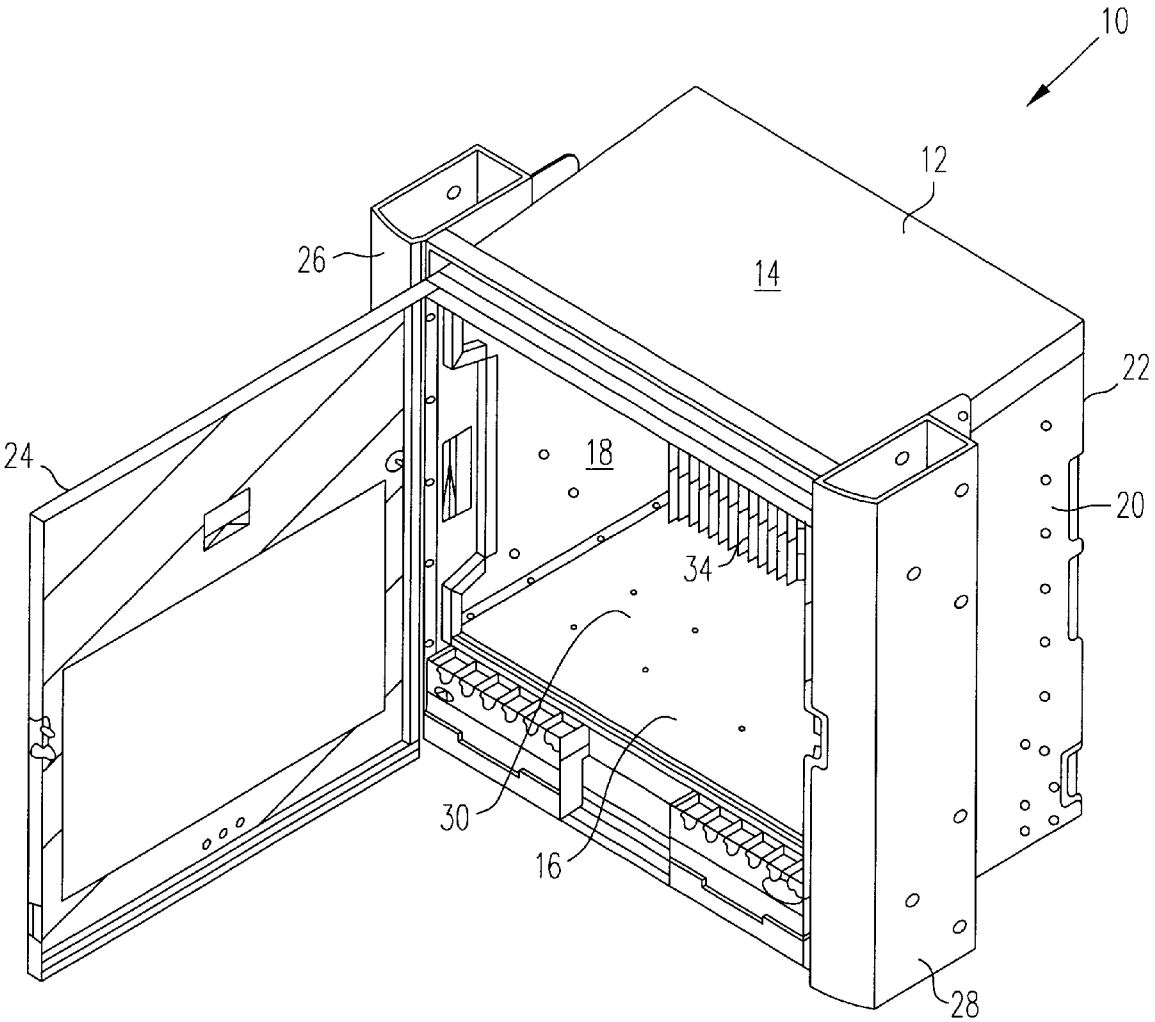
FIG. 1 shows a telecommunications equipment system chassis in accordance with the present invention.

FIG. 1 illustrates a telecommunications equipment system 10, which includes a casing or main chassis 12. Chassis 12 includes several components, such as top wall 14, a bottom wall 16, a side wall 18, a side wall 20, a back wall 22, and a front access door 24. Depending on the embodiment, chassis 12 may have mounting fixtures 26 and 28 located on the side walls 18 and 20 of chassis 12 to facilitate the mounting of system 10. Chassis 12 and mounting fixtures 26 and 28 may be made with sheet metal, injection molded plastic, or other similarly suited structural materials.

Chassis 12 defines an interior cavity or space 30. Interior cavity 30 is suitable for removably receiving one or more electronic apparatuses. In one embodiment, interior cavity 30 is large enough to be capable of removably receiving electronic apparatuses, such as modules, PCAs, or other types of plug-in cards (not shown), which may provide a telecommunications functionality to system 10. Front access door 24 provides access to interior cavity 30 for replacement, removal, assembly, servicing, and/or repair of the electronic apparatuses. Optionally, top and bottom walls 14 and 16 may have slots or grooves used to support, guide, and align the plug-in cards while housed in interior cavity 30.

Figure 2A:
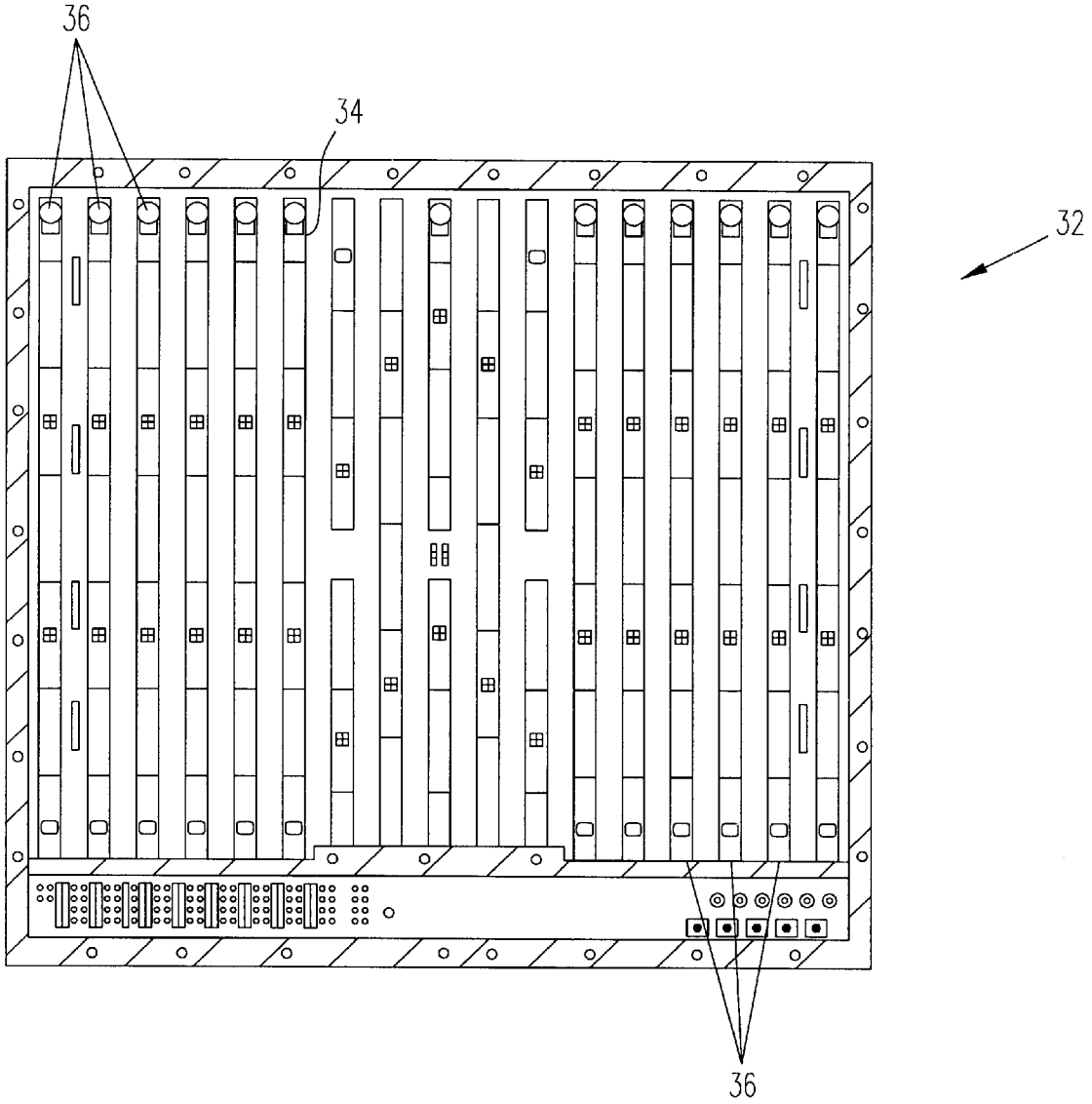
FIG. 2A is a simplified view of an external face of an embodiment of a backplane in accordance with the present invention.
Figure 2B:
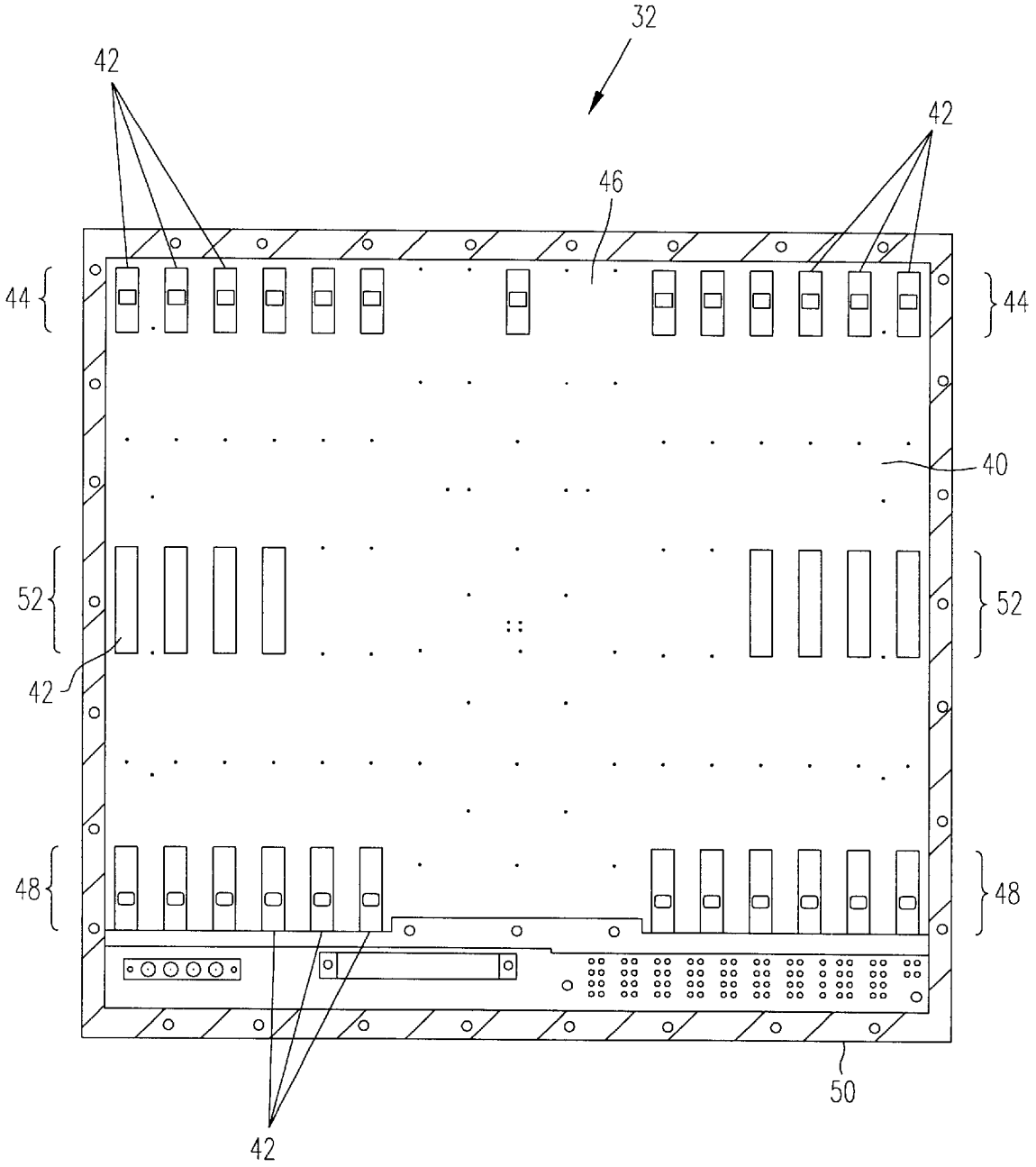
FIG. 2B is a simplified view of an internal face of the backplane in accordance with the present invention.
Figure 2C:
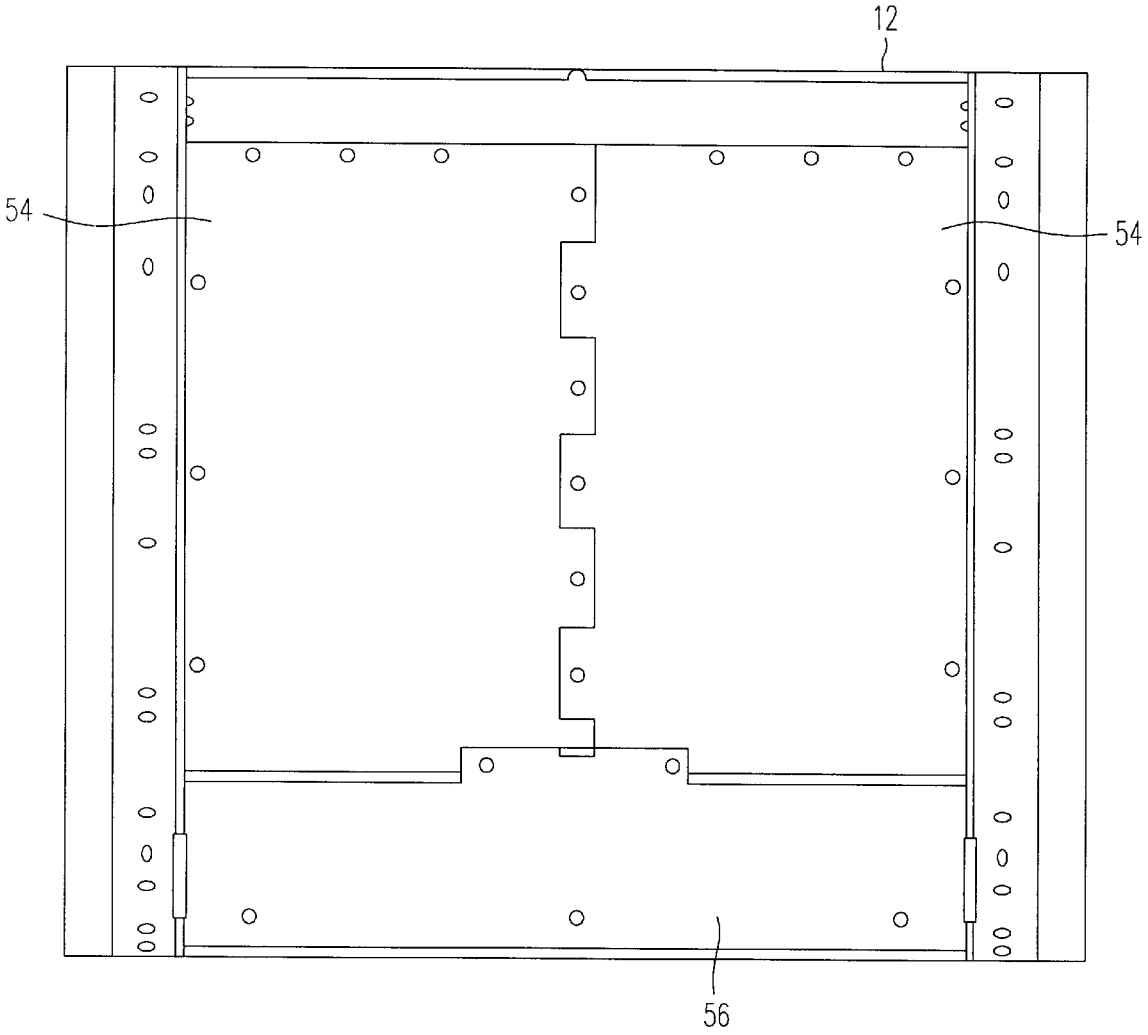
FIG. 2C is a simplified illustration of the backplane of FIG. 2A with a protective cover thereon.

Back wall 22 may include a backplane 32 (FIG. 2A). In one embodiment, backplane 32 is a printed circuit board that extends substantially the width of chassis 12 (FIG. 2C). Backplane 32 includes circuitry identical to circuitry in a conventional backplane well-known in the telecommunications industry, which provides electrical characteristics, such as shielding, conductor path characteristics, including controlled impedance, current carrying capacity, paths for instrument buses, data busses, unit under test (UUT) stimulus busses, and power busses. In the preferred embodiment, backplane 32 provides the electrical interface between the electronic apparatus enclosed in chassis 12 and the external cables. On an internal face 34 of backplane 32, connectors 36A–36N (wherein A≦I≦N; N being the total number of connectors) are provided to engage with the electronic apparatus housed in chassis 12. Connectors 36 may be any types of electrical connector device, preferably a connector compatible with a mating connector provided on the electronic apparatus. The electronic apparatus may include any type of PCA or PCBs, including, but not limited to, DS1, DS3, video, and ethernet plug-in cards. The arrangement of connectors 36 may be varied and will depend on the type of cards to be inserted in the system and the desired or required arrangement of the cards.

On an external face 40 (FIG. 2B) of backplane 32, an array of connectors (hereinafter "backplane connectors") 42A–42M (wherein A≦J≦M; M being the total number of backplane connectors) are provided. Backplane connectors 42 may be provided in any quantity, and in any manner that does not interfere with the operation of backplane 32. The useable space for connectors on backplane 32 is typically very limited, thus, in a preferred embodiment, backplane connectors 42 are arranged in a predetermined layout on external face 40, such as that shown in FIG. 2B. The predetermined layout includes all connectors 42A–42M arranged in three groupings 44, 48 and 52. Each group may include up to six connectors, but optionally, may have more or less as the useable space permits and/or as the application of the equipment may dictate. In one embodiment, first group 44 and second group 48 include six connectors each. In this embodiment, groups 44 and 48 are positioned proximate to top edge 46 and bottom edge 50, respectively, with group 52 located in a central region of external face 40 (between groups 44 and 48). The backplane connectors of group 44 and group 48 may be any suitable connector, such as pin and card edge connectors. Preferably, but not necessarily, the connectors in groups 44 and 48 are pin-type connectors. The number of pins in each connector 42M may vary depending on, but may include 60-, 85-, 125-, and staggered 125-pins. In one embodiment, group 52 includes four backplane connectors. The backplane connectors of group 52 may be any suitable connector, such as pin and card edge connectors, but preferably (but not necessarily) are staggered 125-pin type connectors. Pin connectors, like those described above, are manufactured by, and commercially available from AMP Incorporated, of Harrisburg, Pa.

As shown in FIG. 2C, when backplane connectors 42 of backplane 32 are not being used, a cover 54 may be installed over backplane 32 to provide protection to the backplane and the user.

Figure 3B:
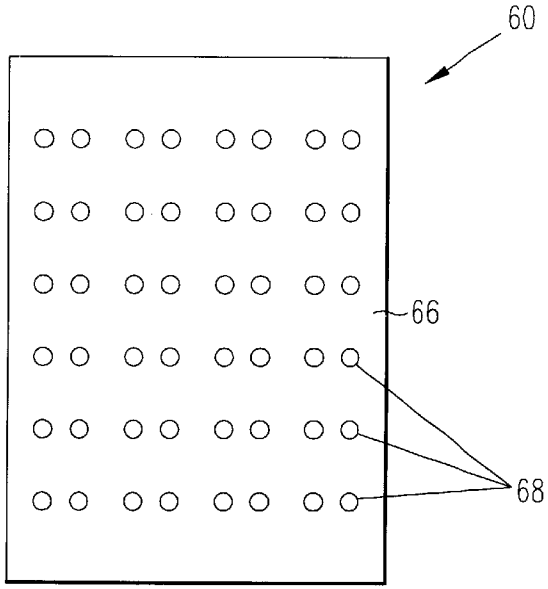
FIGS. 3A and 3B are simplified illustrations of an internal view and external view, respectively, of the interchangeable connection panel of the present invention.
Figure 3C:
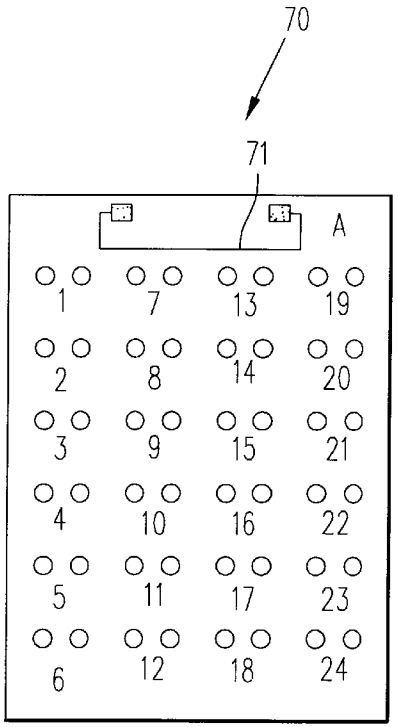
FIG. 3C is a simplified illustration of a faceplate according to an embodiment of the present invention.
Figure 3A:
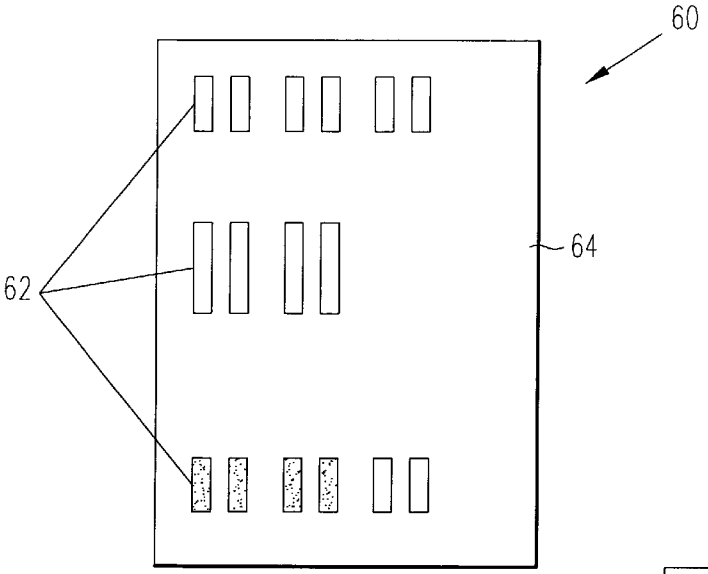

Although, the type, arrangement, and quantity of backplane connectors 42 in each of groups 44, 48 and 52 may be variable, in accordance with the present invention, a corresponding type, arrangement, and quantity of mating connectors are provided on one face of a conversion panel 60 (illustrated in FIGS. 3A–3C). A first side 64 (FIG. 3A) of interchangeable conversion panel 60 has an array of connectors 62A–62M which correspond to and are connectable to backplane connectors 42A–42M on backplane 32. Panel 60 may be manufactured as a printed circuit board, of a type well-known in the telecommunications arts, which provides electrical characteristics, including providing an electrical path or route for signals from/to panel connectors 62 to/from external connectors 68.

A second side 66 (FIG. 3B) of conversion panel 60 has connectors 68A–68P which may be arranged in any manner on second side 66, but are generally arranged in columns and rows. Connectors 68 may be any conventional connectors suitable for telecommunications and/or similar functionality. Preferably, connectors 68 may include SMB, BNC, RJ-45, SMB to WireWrap module, screw terminal block, coaxial F, and champ connectors. As shown in FIG. 3C, a faceplate 70 may be optionally placed over, and conventionally secured to, panel 60, with connectors 68A–68P passing through appropriately placed holes provided thereon. Faceplate 70 provides protection to panel 60 and may include labels and other visual graphics for directing the user in proper connection procedures. Faceplate 70 may also have a handle 71 to facilitate the mounting and/or removal of the interchangeable connection panel.

Figure 4:
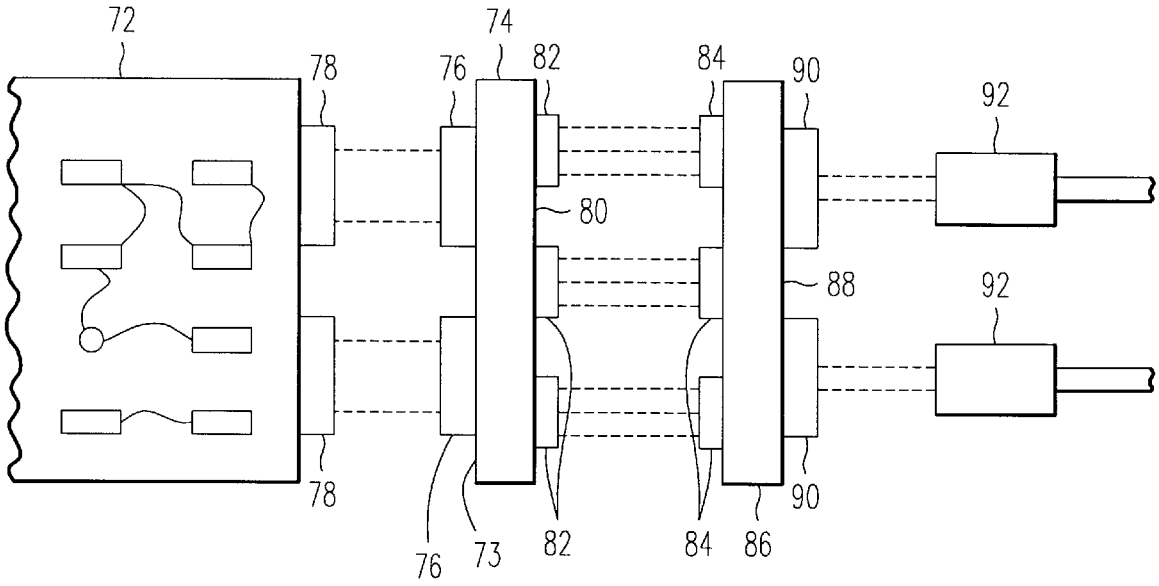
FIG. 4 is a simplified schematic illustration of the operational configuration of components of the present invention.

In one example, plug-in card 72 (FIG. 4) is removably attached to internal face 73 of backplane 74, which includes sockets 76 configured to engage and mate with card connectors 78 to establish an electrical connection therebetween. On external face 80 of backplane 74, pin-connectors 82 are provided of a type and in an array suitable for engaging corresponding connectors 84 provided on conversion panel 86. Connectors 82 and 84 will be collectively referred to as internal connectors 82 and 84. Panel 86 has an external face 88 which is capable of supporting different types of external connectors 90, such as SMB, BNC, RJ-45, SMB-WW module, screw terminal block, coaxial F, and champ connectors. Cable connectors 92 connected to the end of cables, wires or twisted wire pairs, may then be coupled to external connectors 90.

Figure 5A:
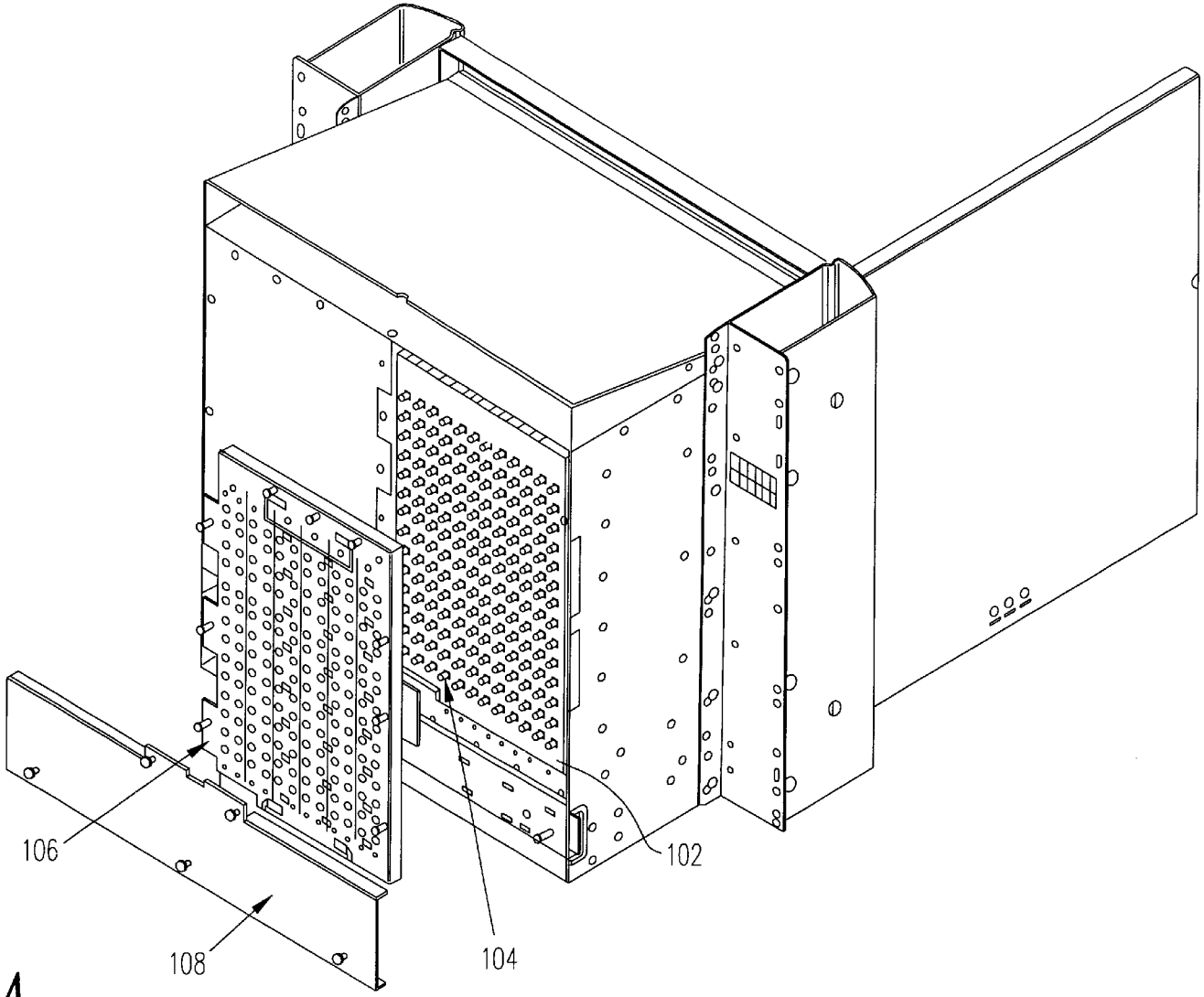
FIGS. 5A and 5B, are simplified schematic illustrations of a specific embodiment of the present invention.
Figure 5B:
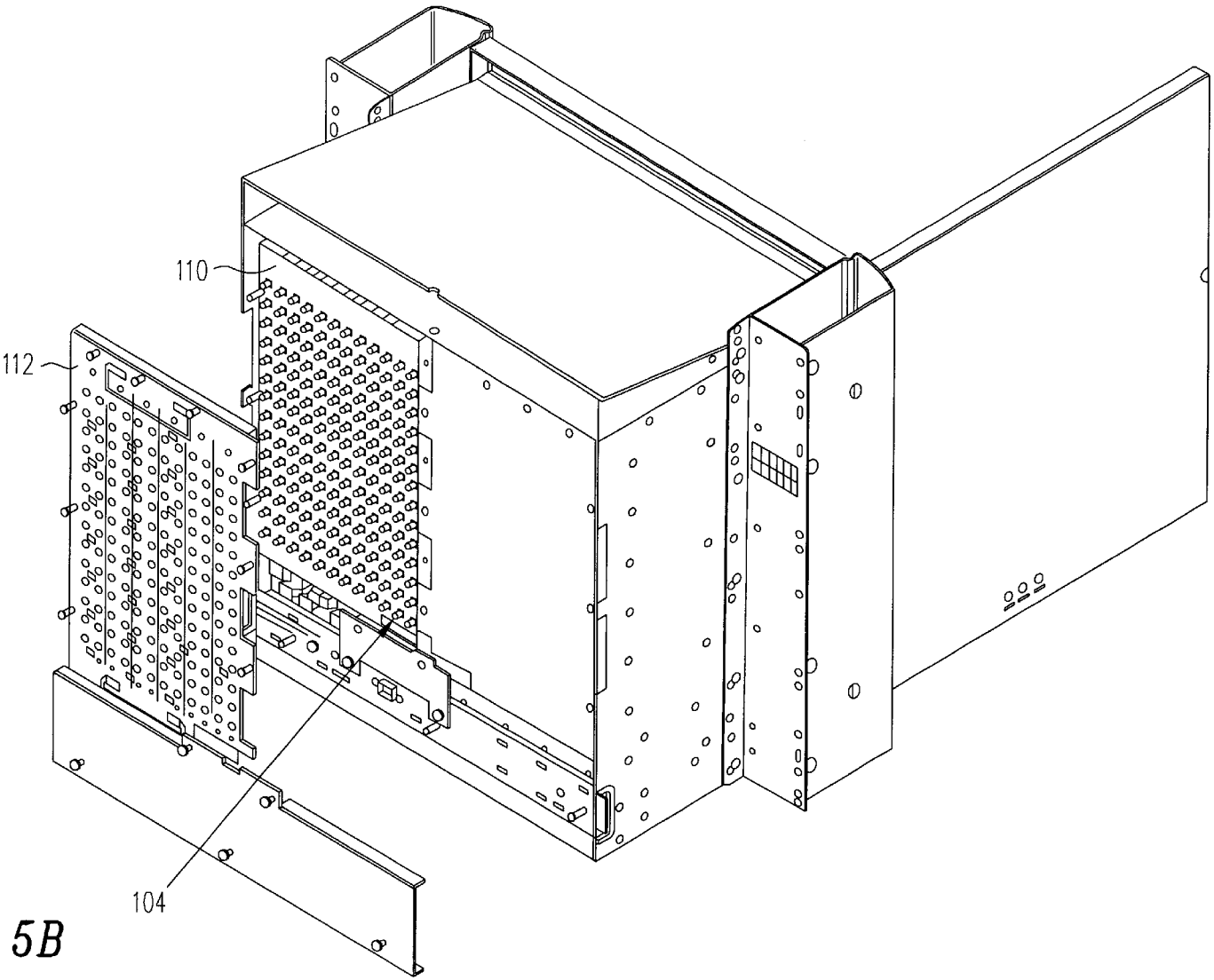

In one embodiment, panel 102 (FIG. 5A) is coupled on a first side to backplane 32 (not shown in FIG. 5A) and supports thereon SMB type connectors 104. In this example, panel 102 only covers a portion of backplane 32 (e.g., only the right half). Panel 102 may then be covered by an SMB faceplate 106. Another panel 108, which provides an interface for alarm signals, may be used to cover a lower portion of the rear of the equipment. Optionally, as shown in FIG. 5B, a left-side panel 110 and a left-side faceplate 112 may be used instead of, or in conjunction with, the right-side panel 102 and faceplate 106.

Figure 6A:
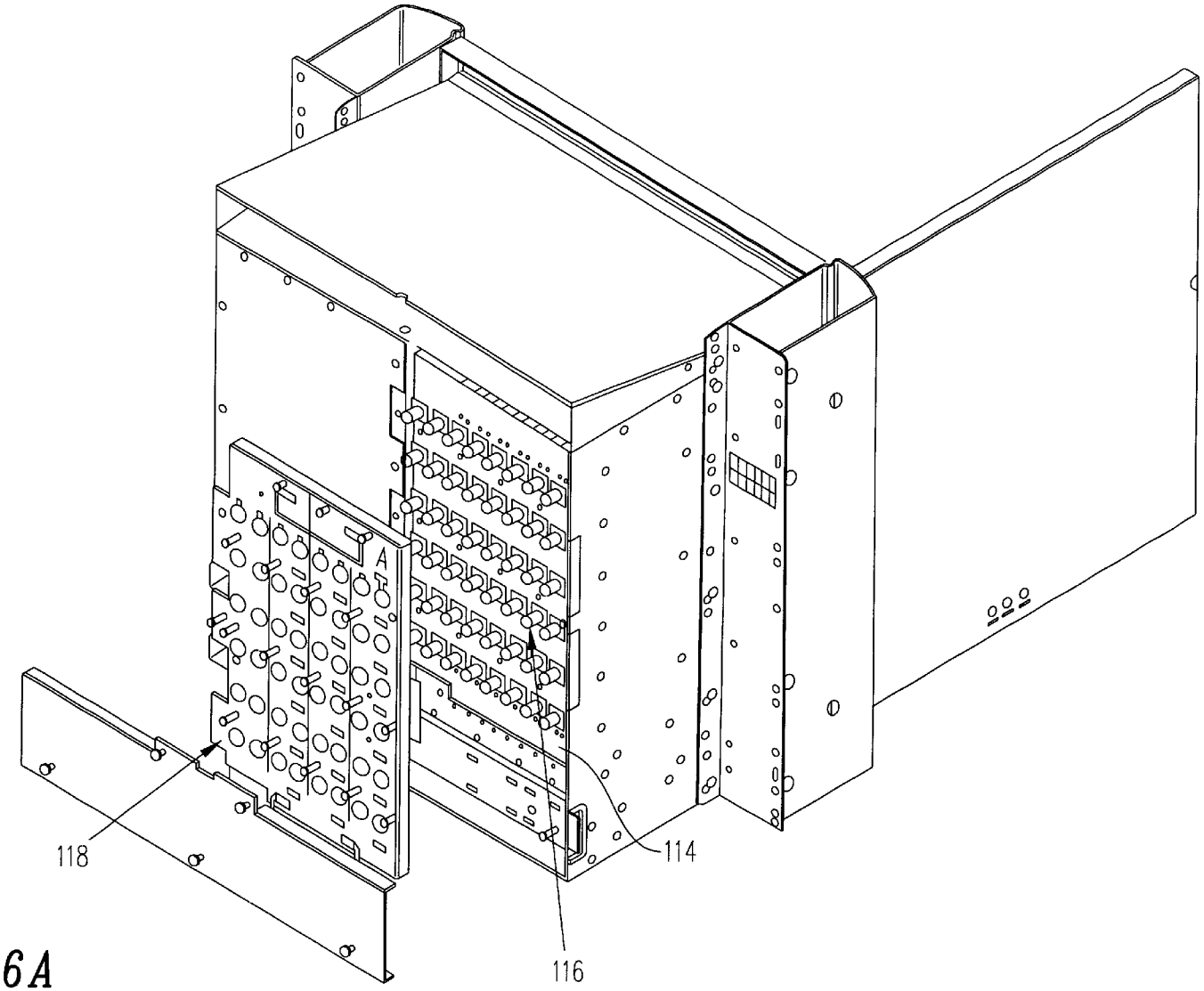
FIGS. 6A and 6B, are simplified schematic illustrations of another specific embodiment of the present invention.
Figure 6B:
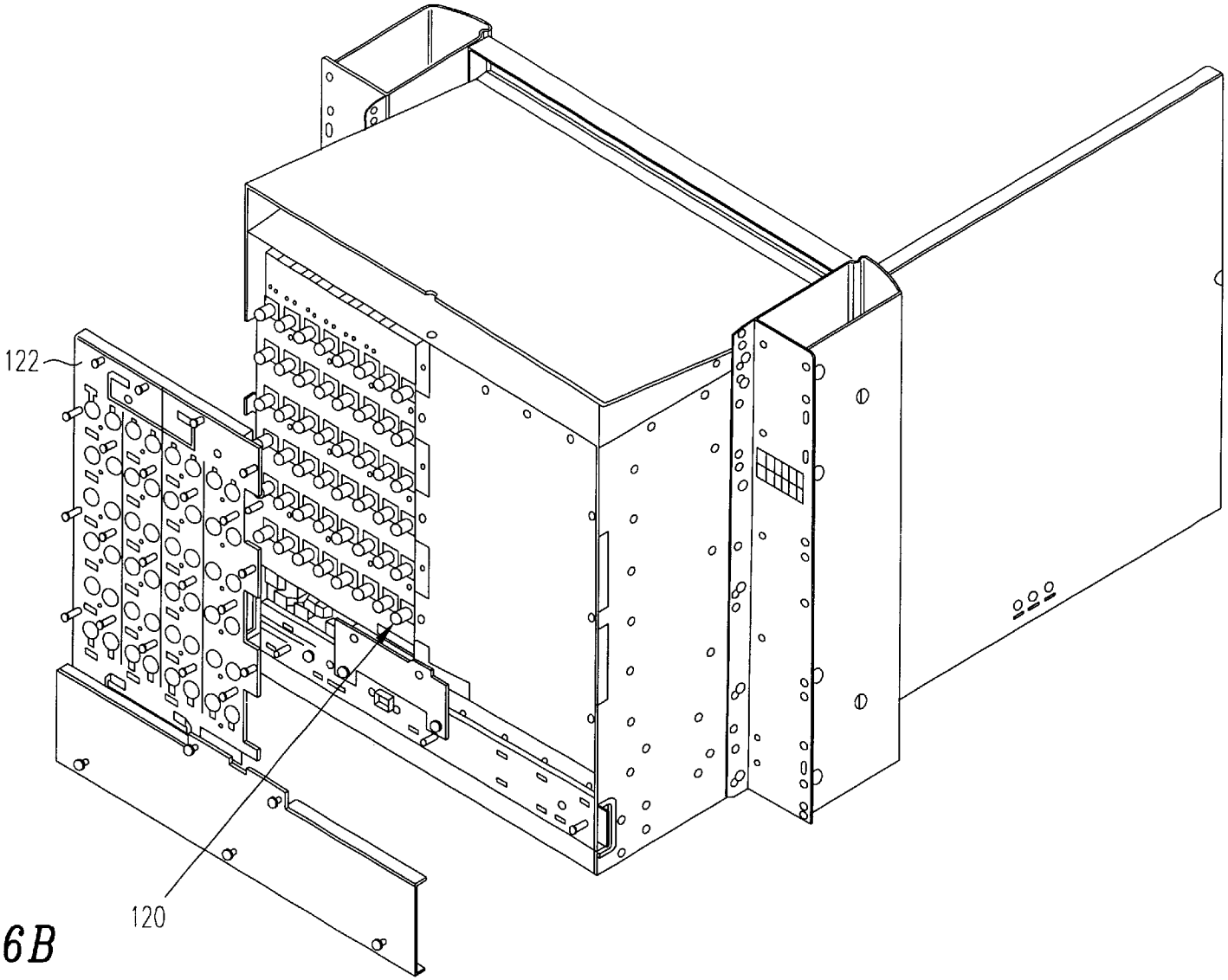

In another embodiment, a conversion panel 114 (FIG. 6A) is coupled on a first side to backplane 32 and supports thereon BNC type connectors 116 instead of SMB type connectors 104 described above in reference to FIGS. 5A and 5B. In all other respects, the embodiment illustrated in FIGS. 6A and 6B is identical to the embodiment illustrated in FIGS. 5A and 5B.

Figure 7A:
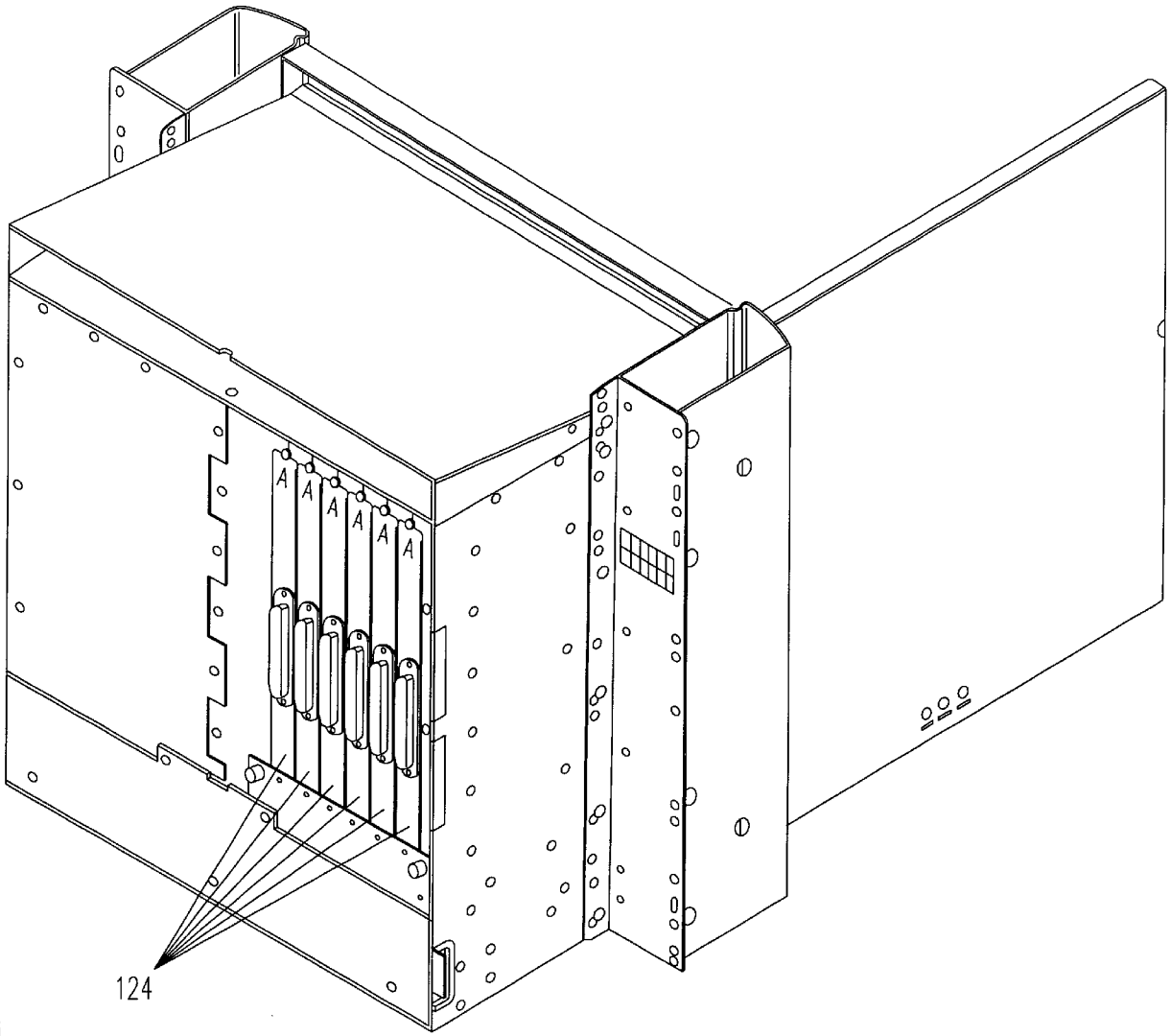
FIGS. 7A and 7B, are simplified schematic illustrations of another specific embodiment of the present invention.
Figure 7B:
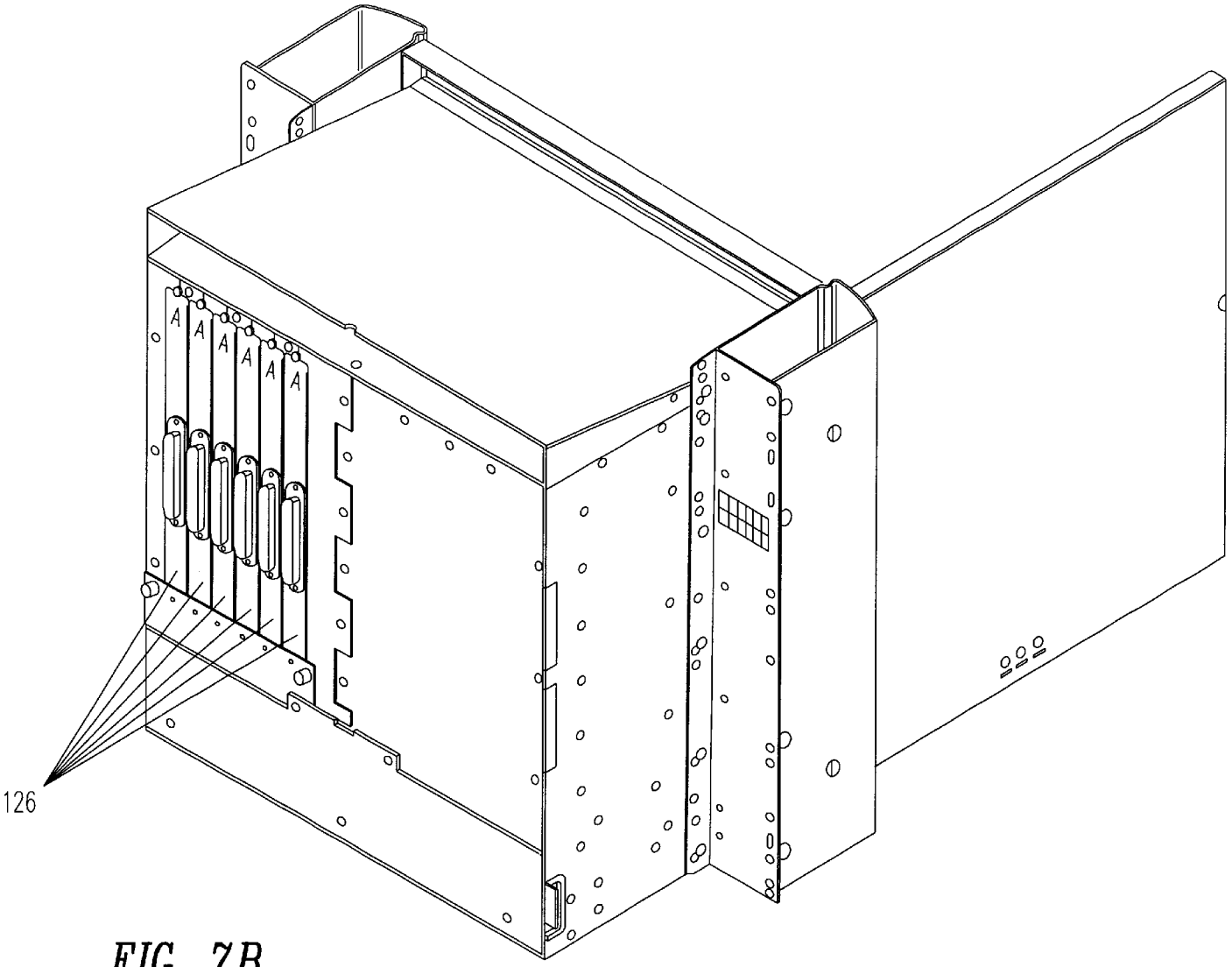

In yet another embodiment, another conversion panel 92 includes multiple champ connectors 124 (FIG. 7A) coupled to the backplane 32 (not shown in FIG. 7A). Specifically, champ connectors 124 may be coupled together, side-by-side, to form a single panel 92, which may then be coupled to backplane connectors 42. Optionally, champ connectors 124 may individually be coupled to individual columns of backplane connectors 42 (FIG. 2B). As shown in FIG. 7B, multiple left-side champ connectors 126 may be used instead of, or in conjunction with, the right-side champ connectors 124. Champ connectors, SMB connectors, and BNC connectors, are all available from AMP Incorporated of Harrisburg, Pa.

Although particular embodiments of the invention have been illustrated and described, modifications and changes will be apparent to those of skill in the art. For example, as different types of plug-in cards continue to evolve, which may require different external connectors than those mentioned above, it is intended to be within the scope of present invention to include all types of external connectors. Such modifications and adaptations of the various embodiments, implementations and examples described herein are encompassed by the attached claims.

What is claimed is:

1. A system for standardizing an electrical connection interface, said system comprising:

a main chassis;

a backplane mounted to said main chassis and having a plurality of backplane connectors of varying configurations; and a panel including first and second opposing sides, said first side having a first plurality of connectors of varying configurations mated with each of said plurality of backplane connectors of varying configurations, said second side having a second plurality of connectors for establishing an electrical connection to an external cable.

2. The system of claim 1, wherein said main chassis defines an interior space for receiving plug-in cards which provide a telecommunications functionality.

3. The system of claim 1, wherein said main chassis defines an interior space for receiving plug-in cards, said plug-in cards taken from the group consisting of DS1, DS3, ethernet, and video cards.

4. The system of claim 1, wherein said external cable is selected from the group consisting of optical fiber cable, electrical cable, coaxial cable, ribbon cable, and twisted wire pair cable.

5. The system of claim 1, further comprising a faceplate mountable over said second side of said panel.

6. The system of claim 1, wherein said plurality of backplane connectors of varying configurations comprise a combination of pin-type connectors taken from the group consisting of 60-pin, 85-pin, 125-pin, and staggered 125-pin connectors.

7. The system of claim 1, wherein said second plurality of connectors are taken from the group consisting of SMB, BNC, RJ-45, SMB-WW modules, screw terminal block, coaxial F, and champ connectors.

8. The system of claim 1, wherein said main chassis comprises a door for enclosing said main chassis at the front.

9. The system of claim 1, further comprising mounting fixtures coupled to each side of said main chassis to facilitate mounting of said main chassis.

10. The system of claim 1, further comprising a protective panel for covering said backplane when said backplane is not in use.

11. The system of claim 1, wherein said panel is mountable to either a left- or right-hand side of said backplane.

12. A system for standardizing an electrical connection interface, said system comprising:

a chassis;

a backplane having a plurality of backplane connectors of varying configurations, said backplane mounted on said chassis; and means mounted to said backplane to convert said plurality of backplane connectors of varying configurations to an array of a single configuration of external connectors.

13. The system of claim 12, wherein said means for converting comprises an interchangeable panel having a front side and a back side, said front side having connector receptacles for mating with said plurality of backplane connectors of varying configurations, said back side having said array of a single configuration of external connectors.

14. The system of claim 12, wherein said plurality of backplane connectors of varying configurations comprises a combination of at least two different connectors taken form the group consisting of a 60-pin connector, an 85-pin connector, a 125-pin connector, and a staggered 125-pin connector.

15. The system of claim 12, wherein said main chassis defines an interior space for receiving plug-in cards, said plug-in cards taken from the group consisting of DS1, DS3, ethernet, and video cards.

16. The system of claim 12, wherein said external connectors are taken from the group consisting of SMB, BNC, RJ-45, SMB-WW modules, screw terminal block, coaxial F, and champ connectors.

17. A method for standardizing an electrical connection interface, said method comprising:

providing a backplane including a backplane connector array;

mounting a conversion panel having a first combination of different configurations of panel connectors to said backplane connector array including a second combination of different configuration of backplane connectors corresponding to each of said panel connectors, said conversion panel having a plurality of external connectors for establishing an electrical connection to at least one external cable.

18. A method as in claim 17, wherein said external connectors are taken from the group consisting of SMB, BNC, RJ-45, SMB-WW modules, screw terminal block, coaxial F, and champ connectors.

19. The method of claim 17, wherein said external cable is selected from the group consisting of optical fiber cable, electrical cable, coaxial cable, ribbon cable, and twisted wire pair cable.

* * * * *